US012474148B2

(12) United States Patent
Kent

(10) Patent No.: US 12,474,148 B2
(45) Date of Patent: Nov. 18, 2025

(54) CARTRIDGE PRIMER AND METHOD OF MANUFACTURE

(71) Applicant: Howard D. Kent, Waldport, OR (US)

(72) Inventor: Howard D. Kent, Waldport, OR (US)

( * ) Notice: Subject to any disclaimer, the term of this patent is extended or adjusted under 35 U.S.C. 154(b) by 145 days.

(21) Appl. No.: 18/517,643

(22) Filed: Nov. 22, 2023

(65) Prior Publication Data

US 2025/0164224 A1 May 22, 2025

(51) Int. Cl.
*F42B 33/04* (2006.01)
*F42B 33/00* (2006.01)
*F42C 19/08* (2006.01)

(52) U.S. Cl.
CPC ..... *F42C 19/0823* (2013.01); *F42B 33/001* (2013.01); *F42B 33/04* (2013.01)

(58) Field of Classification Search
CPC .. F42C 19/08; F42C 19/0807; F42C 19/0823; F42C 19/083; F42C 19/085; F42C 19/10; C06C 7/00; C06C 7/02; C06B 21/00; C06B 21/0091; F42B 33/00; F42B 33/001; F42B 33/04
USPC ..... 102/204
See application file for complete search history.

(56) References Cited

U.S. PATENT DOCUMENTS 962,888 A * 6/1910 Buell ..... F42C 19/10 102/204
1,900,159 A * 3/1933 Campbell ..... F42C 19/10 102/470
2,021,498 A * 11/1935 Campbell ..... F42C 19/10 102/470
2,529,704 A * 11/1950 Olsen ..... C06B 21/0091 34/266
3,777,664 A * 12/1973 Gawlick ..... F42C 19/10 102/293
5,481,978 A * 1/1996 Muller ..... F42B 5/36 102/470
7,980,178 B1 * 7/2011 Yalamanchili ..... C06B 33/08 102/204
9,644,930 B1 * 5/2017 Burrow ..... F42B 33/001
(Continued)

FOREIGN PATENT DOCUMENTS

EP 4283243 A1 * 11/2023 ..... F42B 5/36
GB 253395 A * 6/1926 ..... F42C 19/10
WO WO-2025111115 A1 * 5/2025

OTHER PUBLICATIONS

PCT Search Report in PCT/US2024/053475 (Year: 2025).*
PCT Opinion in PCT/US2024/053475 (Year: 2025).*

*Primary Examiner* — James S Bergin
(74) *Attorney, Agent, or Firm* — PARSONS & GOLTRY; Robert A. Parsons; Michael W. Goltry

(57) ABSTRACT

A method of assembling a primer for a firearm cartridge including the steps of providing a primer cup including a cup base with a circular sidewall extending perpendicularly upward from a perimeter edge thereof, to a rim. Providing an anvil having an anvil base and pressing the anvil into the primer cup with the anvil base spaced apart from the cup base to form a primer gap therebetween. Providing a slurry including a primer composition and a carrier liquid and introducing a controlled volume of the slurry into the primer cup over the anvil. Drying the slurry in the primer cup to remove the liquid carrier and leave a deposit of the primer composition in the primer gap.

18 Claims, 6 Drawing Sheets

(56) References Cited

U.S. PATENT DOCUMENTS

| | | | | |
|---|---|---|---|---|
| 10,260,847 | B2 * | 4/2019 | Viggiano | F42B 33/04 |
| 10,976,144 | B1 * | 4/2021 | Peterson | F42C 19/083 |

* cited by examiner

CARTRIDGE PRIMER AND METHOD OF MANUFACTURE

FILED OF THE INVENTION

This invention relates to firearm cartridges and more specifically to primers for firearm cartridges.

BACKGROUND OF THE INVENTION

In the field of firearm ammunition, rim fire and center fire cartridges are employed for small arms. Rim fire cartridges are used for small calibers, primarily the 0.22 long rifle, and center fire cartridges are used for most other pistol, rifle and shotgun cartridges. This invention is directed to center fire cartridges. Cartridges in most firearms today include a casing containing a propellant charge, a primer and a projectile. The case is typically made of brass or another metal alloy that resists corrosion and pressure and has a seat in which a primer is fit. A firearms primer consists of a cup or cap which is filled with an energetic compound that when impacted by a firing mechanism (firing pin or hammer) crushes the compound between either an external or internal "anvil" and the inside of the cup or cap. The action of the weapon's firing pin or hammer causes the cup or cap to deform inward against the anvil which initiates flame and hot particles flowing from the primer into the propellant within the case. With reference to FIG. 1, a Boxer type primer and a Berdan type primer are illustrated. In the case of the Boxer type primer, an internal anvil is carried by the cup over the primer compound, the flash hole allowing the passage of the flame and particles is central while that of the Berdan type consists of two or more holes located around an external anvil carried by the cartridge case.

Current Boxer type and Berdan type centerfire primers for firearms ammunition are constructed of two elements; a cup and an anvil which may consist of a separate component of the case and the cup in the example of a Berdan type primer or a cup and anvil assembly in a Boxer type design. In both cases, the cup element of the primer is filled with primer compound prior to the insertion of the anvil in the Boxer type design and prior to insertion into the priming pocket facing the standing anvil of the cartridge case in the Berdan type. FIG. 1 illustrates the Berdan type primer on the right. The Berdan type primer has the external anvil element formed into the case of the cartridge base, and a simple cup filled with priming compound completing the system. On the left is the Boxer type primer which has an empty pocket of the cartridge case requiring the primer assembly to contain an internal anvil. In both styles, the deforming cup from a hammer or firing pin strike bears against the anvil (internal or external) in order to crush the priming compound in the priming gap between the cup and anvil.

The focus of the current invention is the Boxer type primer. Current Boxer type anvils are stamped from 0.5-0.8 mm Copper or Brass material with a pointed or truncated cone projection from the bottom forming the priming gap with the cup. The truncated cone forms a bowl-shaped deformation of the upper surface opposite the bottom of the primer cup between 2-3 "legs" of the anvil. Current primers used for military and commercial purposes are filled with a wet primer composition having the consistency of clay. The primer composition is extremely volatile and is mixed with a liquid to prevent detonation. The resulting clay like primer composition is pliable and is shaped, generally through manual insertion into volumetric measure plates, to form precisely measured pellets. These pellets are then pressed into primer cups. A protective paper layer is typically required between the anvil and the pellet. During manufacturing, the paper layer is used to prevent the accumulation of energetic primer compounds on the presses or punches used to remove the pellets from the volumetric measure plates and press them into the primer cups. The anvil is then pressed into the cup over the primer composition and paper layer, capturing the primer composition in the primer gap between the truncated cone and the cup. The primers are then dried until all the liquid medium is eliminated. Generally, the dried primers are sealed with a waterproofing material which is then also dried prior to use or sale. This is an extremely dangerous process since the composition is extremely volatile and any dried material can be set off. Many people are injured or killed in this process even with the strictest safety procedures in place.

It would be highly advantageous, therefore, to remedy the foregoing and other deficiencies inherent in the prior art.

An object of the present invention is to provide a primer anvil allowing a safer primer fabricating process.

Another object of the present invention is to provide a safer primer assembly process.

SUMMARY OF THE INVENTION

Briefly to achieve the desired objects and advantages of the instant invention in accordance with a preferred embodiment, provided is a method of assembling a primer for a firearm cartridge. The method includes providing a primer cup including a cup base with a circular sidewall extending perpendicularly upward from a perimeter edge thereof, to a rim. An anvil is provided having an anvil base and at least two upright legs, each of the at least two upright legs extending upwardly from a separate end of the anvil base. The anvil base has open side edges and a top surface. The top surface is flat or convex in a transverse direction between the side edges. The method further includes pressing the anvil into the primer cup with the top surface facing away from the cup base. The at least two upright legs overly and abut the circular sidewall and extend from proximate the rim to the anvil base. The anvil base is spaced apart from the cup base to form a primer gap therebetween. A slurry including a primer composition and a carrier liquid is provided. A controlled volume of the slurry is introduced into the primer cup over the anvil. The slurry in the primer cup is dried to remove the liquid carrier and leave a deposit of the primer composition in the primer gap.

Also provided is a primer for a firearm cartridge. The primer includes a primer cup including a cup base with a circular sidewall extending perpendicularly upward from a perimeter edge thereof, to a rim. An anvil includes at least two upright legs extending perpendicularly upwardly from ends of an anvil base. The anvil base has a top surface directed away from the cup base and side edges forming open sides. The top surface of the anvil base is flat or convex in a transverse direction between the side edges to prevent any fluid collection areas on the surface. The anvil is received within the primer cup with the upright legs overlying and abutting the circular sidewall and extending from proximate the rim to the anvil base, and a primer gap is defined between the cup base and the anvil base. A primer composition is deposited on the cup base in the gap from a slurry.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION

Figure 1:
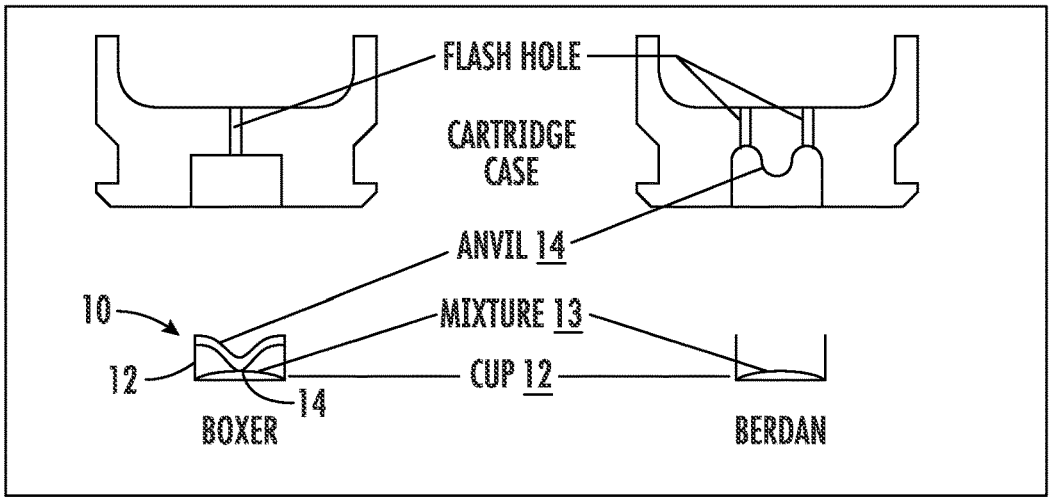
FIG. 1 PRIOR ART
FIG. 1 is a sectional side view of a Boxer type primer and a Berdan type primer and associated cartridge cases of the prior art in a comparison.
Figure 2:
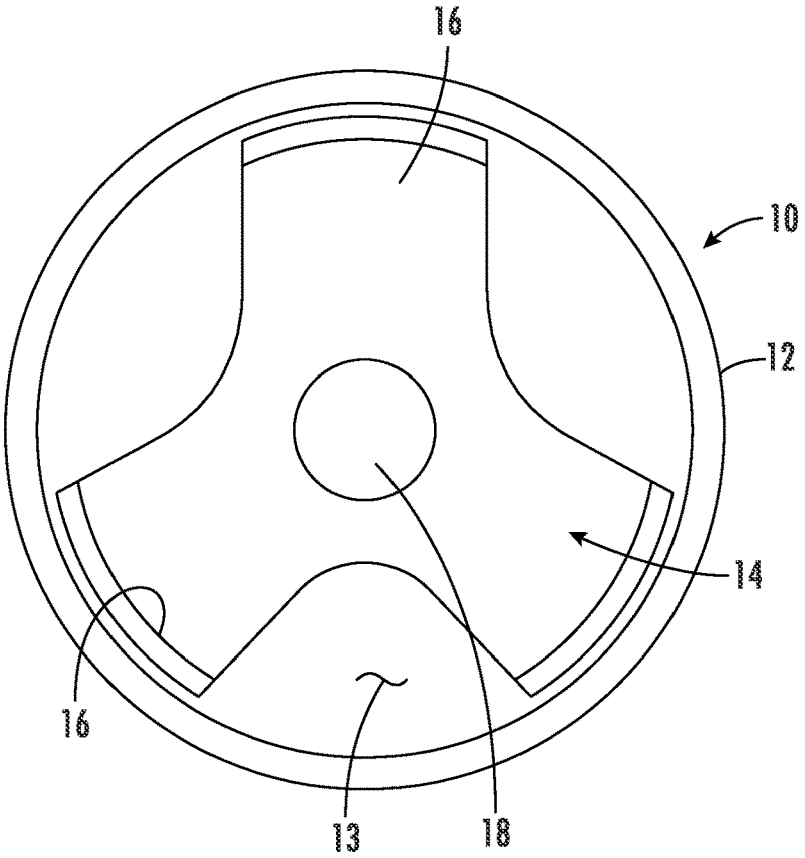
FIG. 2 PRIOR ART
FIG. 2 is a top view of a prior art primer.

Turning now to the drawings in which like reference characters indicate corresponding elements throughout the several views, attention is directed to FIG. 2 which illustrates a top view of a prior art primer generally designated 10. Primer 10 includes a primer cup 12 having a primer composition 13 placed therein. An anvil 14 is pressed into cup 12 capturing primer composition 13 in a space between the base of cup 12 and anvil 14. Primer composition 13, carried in the gap between the base of cup 12 and a conical tip of anvil 14, is ignited when a firing pin crushes the base of cup 12 against anvil 14. Anvil 14 includes a conical member 15 extending dowwardly and centrally in cup 12 (FIG. 1) and includes three legs 16 extending upwardly and engaging the sides of cup 12. The shape of anvil 14 forms a depression 18 within legs 16 and conical member 15 at the center. This is important for purposes which will be discussed presently, but the fabrication process includes providing cup 12, packing primer composition 13 into cup 12 then inserting anvil into cup 12.

Figure 3:
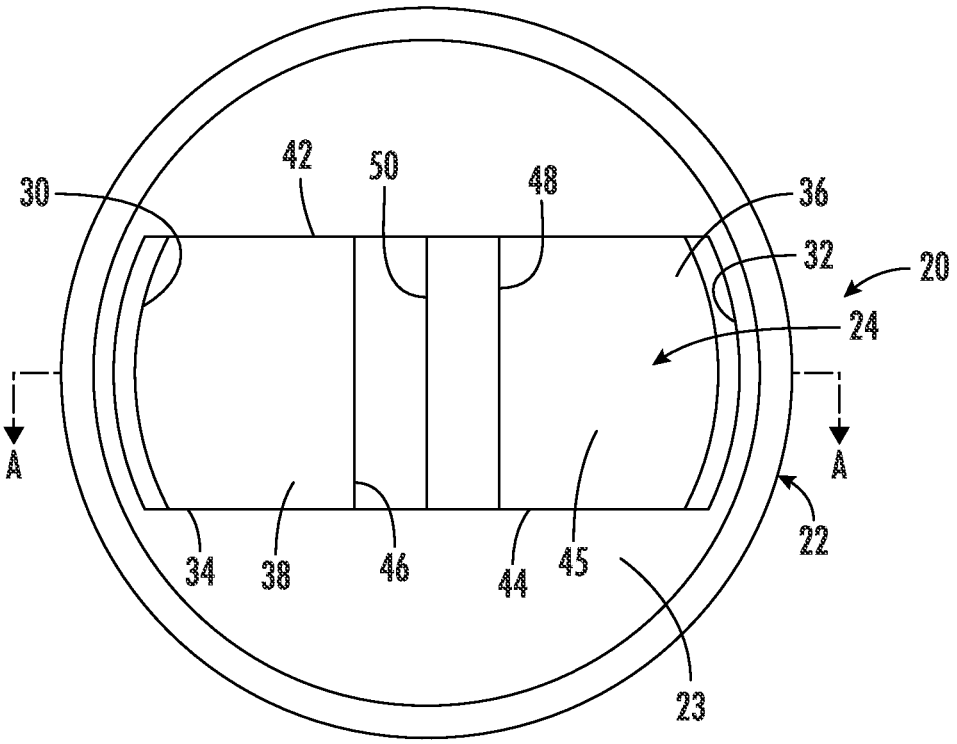
FIG. 3 is a top view of a primer according to the present invention.
Figure 4:
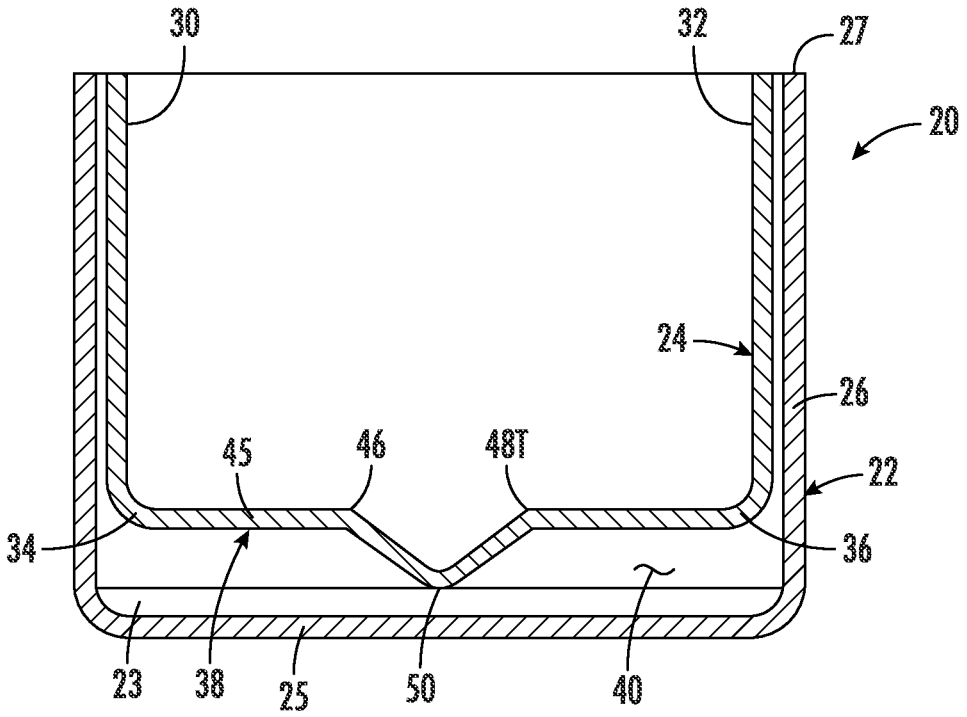
FIG. 4 is a sectional side view of the primer of FIG. 3 taken along line A-A.

Turning now to FIGS. 3 and 4, illustrated is a primer, generally designated 20, according to the present invention. Primer 20 includes a primer cup 22, an anvil 24 carried therein and a primer composition 23. Primer cup 22 includes a cup base 25 with a circular sidewall 26 extending perpendicularly upward from a perimeter edge thereof to a rim 27. For purposes of orientation, cup base 25 of primer cup 22 is considered the bottom of primer 20 with an upward direction being away from cup base 25 and a downward direction toward cup base 25. Anvil 24 includes curved upright legs 30 and 32 extending perpendicularly upwardly from ends 34 and 36 of an anvil base 38. The curve of upright legs 30 and 32 match the curve of circular sidewall 26. When anvil 24 is properly positioned within primer cup 22, upright legs 30 and 32 extend from proximate rim 27 to anvil base 38, overlying and abutting circular sidewall 26, and a gap 40 is defined between cup base 25 and anvil base 38. Primer composition 23 is located in gap 40 on cup base 25. Anvil base 38 has opposing side edges 42 and 44 defining a top surface 45 with sides open to primer cup 22 and can be a flat bar or shaped as illustrated. In any case, anvil base 38 must be flat or slightly convex in a transverse direction between side edges 42 and 44 to permit a slurry to flow around anvil base 38 into gap 40. A slurry placed on anvil base 38 will flow off over side edges 42 and 44 and not remain on top of anvil base 38. This is critical to the present invention as will be discussed presently. While anvil base 38 can be flat longitudinally, in this preferred embodiment, anvil base 38 has transverse downward bends 46 and 48 and a transverse upward bend 50 intermediate downward bends 46 and 48. Bends 46, 48, and 50 in anvil base 38 form a downwardly pointed transverse channel 52. Channel 52 gives strength to anvil base 38 and forms a first area of contact with the cup base 25 of cup 22 when deformed by a firing pin. As can be seen, while anvil base 38 may not be flat in the longitudinal direction due to bends 46, 48, and 50, in the transverse direction between side edges 42 and 44, anvil base 38 is flat allowing slurry to flow off of top surface 45 over the open sides at side edges 42 and 44.

Figure 5:
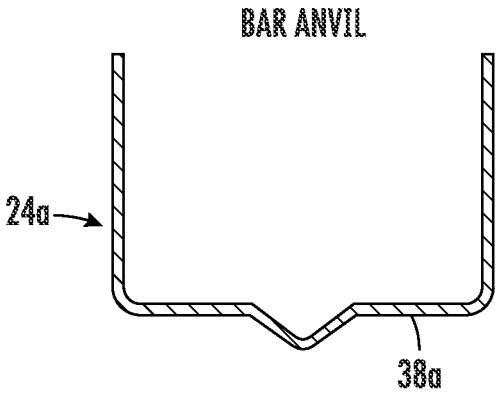
FIG. 5 is a sectional side view of the anvil of FIGS. 3 and 4.
Figure 6:
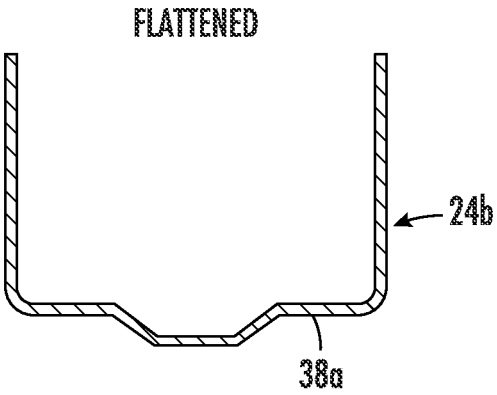
FIG. 6 is a sectional side view of the anvil of FIG. 5 with a flattened base.
Figure 7:
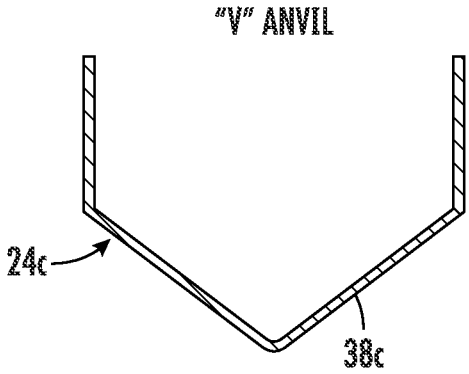
FIG. 7 is a sectional side view of an anvil having a V-shaped base.
Figure 8:
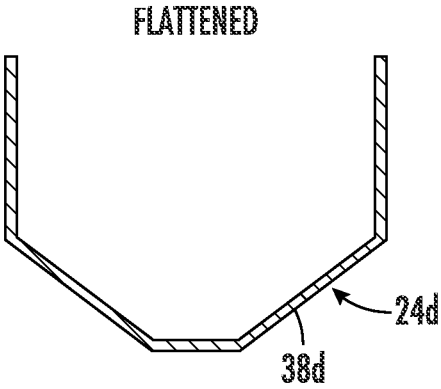
FIG. 8 is a sectional side view of the anvil of FIG. 7 with a flattened base.

Turning now to FIGS. 5-8, cross-sectional views of anvils 24*a-d*, each with a different shaped anvil base 38*a-d*, are illustrated. Each is an example of potential different shaped bases which can be used in the present invention. FIG. 5 illustrates anvil 24*a* having an anvil base 38*a* with a shape identical to that shown and described with respect to FIGS. 3 and 4. FIG. 6 illustrates anvil 24*b* having an anvil base 38*b* with a base similar to anvil base 38*a* but with a flattened tip. FIG. 7 illustrates anvil 24*c* having an anvil base 38*c* being V-shaped. FIG. 8 illustrates anvil 24*d* having an anvil base 38*d* with a base similar to anvil base 38*c* but with a flattened tip. Each of these shapes is an example with a lower portion positioned generally above the deformation point of cup base 25 of primer cup 22. Other shapes can be utilized, but common to all is the requirement that anvil bases 38*a-d* must be flat or convex in the transverse direction between edges 42 and 44. These variations each feature open sides and can be pointed as a "V", rounded as in a "U" or flattened on the bottom to form a line across the anvil design as opposed to a point. The purpose of the shape is to maintain a flat or convex surface in the transverse direction to provide a means for a slurry of primer composition 23 to flow over the anvil down to the base of the priming cup and into priming gap 40 without being trapped on top surface 45 of anvil 24 as it would be in a traditional anvil.

Figure 9:
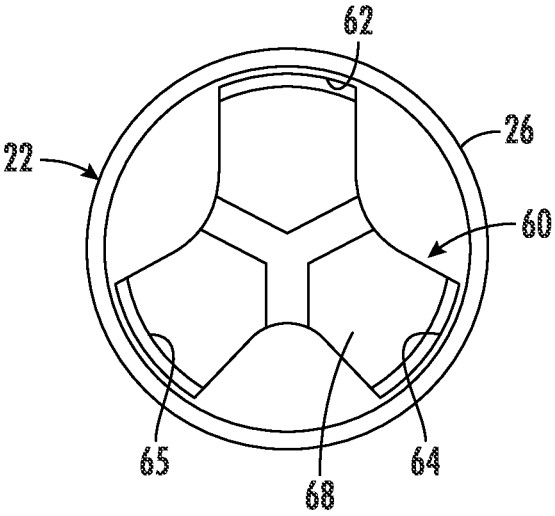
FIG. 9 is a top view of a primer having an anvil with three legs, according to the present invention.

Referring now to FIG. 9, while anvil 24 preferably includes two legs, it will be understood that an anvil 60 can be employed having three or more legs. Anvil 60 includes curved upright legs 62, 64 and 65 extending perpendicularly upwardly from the ends of a Y-shaped base 68. The curve of upright legs 62, 64 and 65 match the curve of circular sidewall 26. When anvil 60 is properly positioned within primer cup 22, upright legs 62, 64 and 65 overlie and abut circular sidewall 26 and extend from proximate rim 27 to anvil base 68. Each portion of Y-shaped base 68 has open sides. Base 68 is flat or slightly convex between edges to permit a slurry to flow thereover and not be caught on top.

Figure 10:
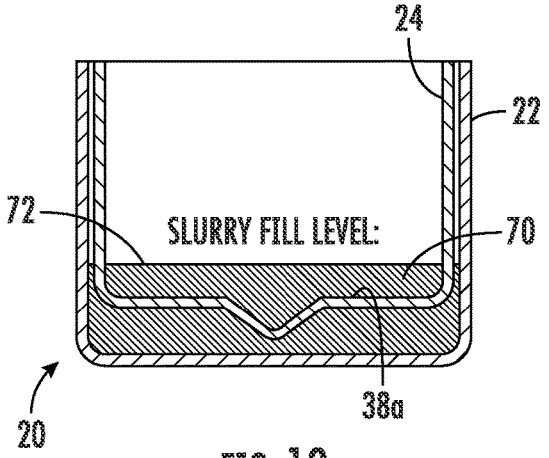
FIG. 10 is a sectional side view of the primer of FIGS. 3 and 4 filled with a slurry.
Figure 11:
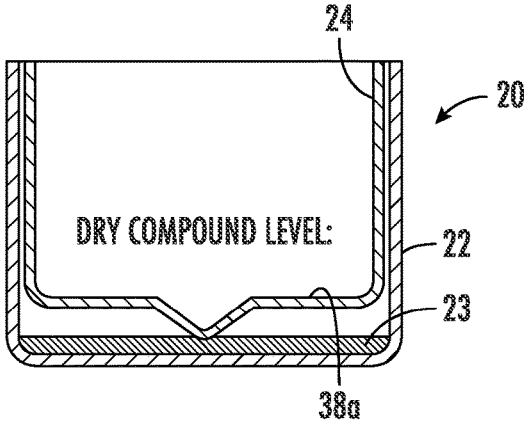
FIG. 11 is a sectional side view of the primer of FIG. 10 with the slurry dried to the final primer composition.

Turning now to FIGS. 10 and 11, a slurry 70 of primer composition 23 is deposited into primer cup 22 containing anvil 24. For purposes of the present invention, a slurry is a suspension of solid particles in a liquid carrier. The slurry contains at least 10% and no more than 60% primer composition solids. Slurry 70 is sufficiently liquid to allow pipetting thereof into primer cup 22. Slurry 70 is deposited into primer cup 22 to a fill level 72. As can be seen with specific reference to FIG. 10, in this embodiment, fill level 72 is above anvil base 38 of anvil 24. A very specific and repeatable volume of slurry 70 is introduced, in this example, by pipette, preferably remotely by automation. However, it will be understood that while a pipette channel is preferred, other items can be used to controllably introduce slurry, including pumps, sprayers, pin applicators and even ink jet printer heads and the like. At this point, each element of primer 20 is present. Primer 20 is then dried to remove the carrier liquid from slurry 70. During the drying process and removal of the carrier liquid from slurry 70, the level of slurry 70 is lowered below fill level 72. With specific reference to FIG. 11, when the carrier liquid is removed in the drying process, the remaining deposit between cup base 25 and anvil base 38 is primer composition 23. It will be noted that slurry 70 flows over anvil 24 to fill primer cup 22 during introduction of slurry 70, and flows off of anvil base 38 of anvil 24 during the drying process as the level is lowered below anvil base 38. In this specific example, anvil base 38 of anvil 24 is the shape illustrated in FIGS. 3-5 and specifically labelled 38*a* in FIG. 5.

Figure 12:
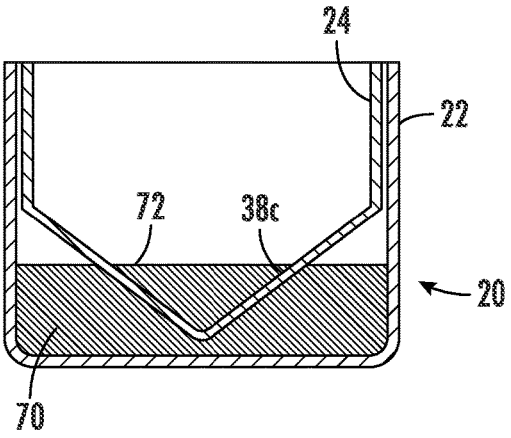
FIG. 12 is a sectional side view of the primer of FIGS. 3 and 4 with the anvil base of FIG. 7 filled with a slurry.
Figure 13:
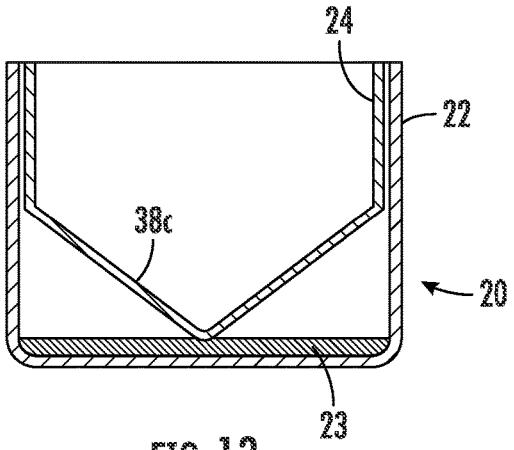
FIG. 13 is a sectional side view of the primer of FIG. 12 with the slurry dried to the final primer composition

Referring to FIGS. 12 and 13, the introduction of slurry 70 to a primer 20 having an anvil base 38*c* from FIG. 7 is illustrated to show that different shaped bases can be used for anvil 24. Slurry 70 is deposited into primer cup 22 to a fill level 72. As can be seen with specific reference to FIG. 12, in this specific embodiment, fill level 72 is above a portion of anvil base 38*c* of anvil 24. A very specific and repeatable volume of slurry 70 is controllably introduced by pipette, preferably remotely by automation. As discussed previously, other device for dispensing a controllable volume of slurry can be used. At this point, each element of primer 20 is present. Primer 20 is then dried to remove the carrier liquid from slurry 70. During the drying process and removal of the carrier liquid from slurry 70, the level of slurry 70 is lowered below fill level 72. With specific reference to FIG. 13, when the carrier liquid is removed in the drying process, the remaining deposit between cup base 25 and anvil base 38*c* is primer composition 23. As with the previous example, as the slurry level is lowered, it will flow off of anvil base 38*c* and not be retained thereon.

Figure 14:
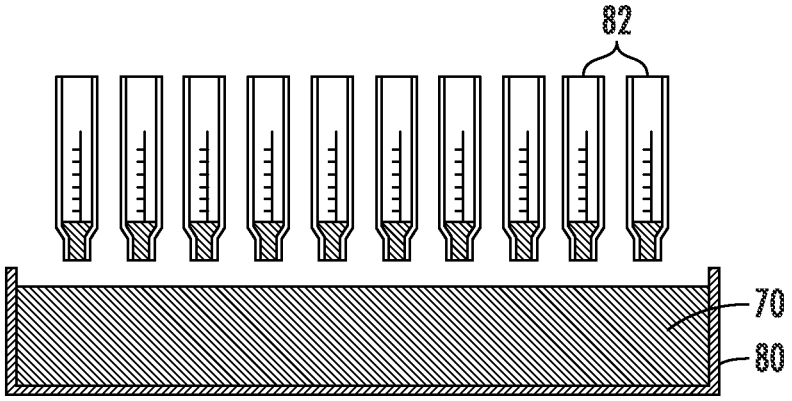
FIG. 14 is a side schematic view of pipette channels and slurry reservoir.
Figure 15:
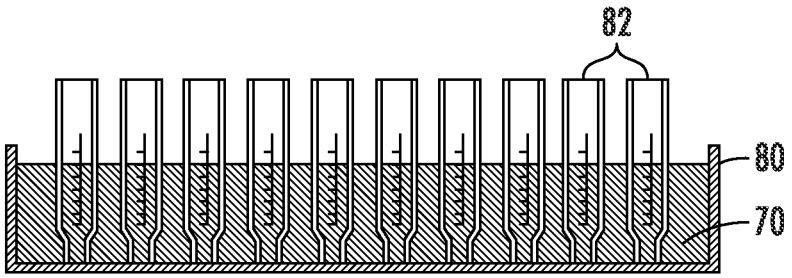
FIG. 15 is a side schematic view of pipette channels receiving slurry.
Figure 16:
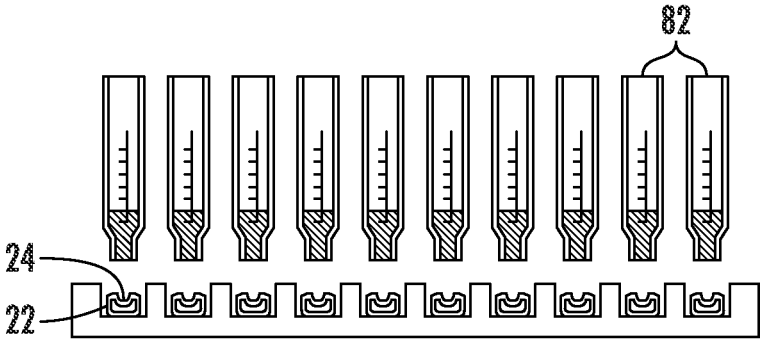
FIG. 16 is a side schematic view of pipette channels positioned for delivering slurry.
Figure 17:
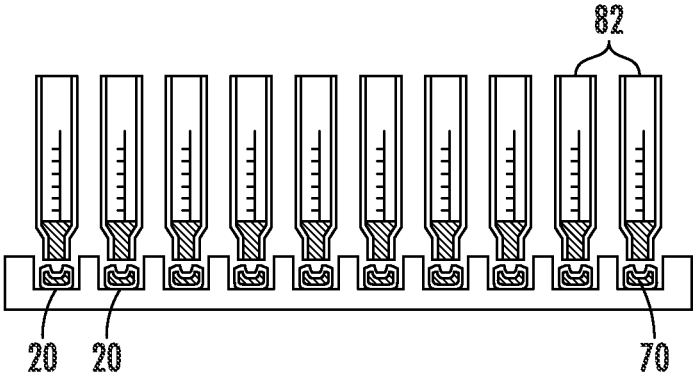
FIG. 17 is a side schematic view of pipette channels introducing slurry to the cup and anvil.

In FIGS. 14-17, illustrated is a method of introducing slurry 70 into primer cups 22 each carrying an anvil 24. A reservoir 80 of slurry 70 is available to a plurality of pipette channels 82 as shown in FIG. 14. In FIG. 15, pipette channels 82 are shown lowered into reservoir 80 to draw a specific volume of slurry 70 therein. In FIG. 16, the plurality of pipette channels is each positioned over a primer cup 22 and anvil 24 combination. In FIG. 17, Each pipette channel introduces a controlled volume of the slurry into an associated primer cup 22 as described with respect to FIGS. 10 and 11. It will be understood that the pipette channels can be any number from 1 and higher, and can be used manually, or as preferred, in an automated system to remove operators from potentially hazardous conditions. A single-channel pipette is a non-disposable instrument with an air-displacement design that generates precise measurement results using a single disposable tip. A multichannel pipette is comparable to a single-channel pipette, except it may hold many tips simultaneously. Either can be used herein.

Figure 18:
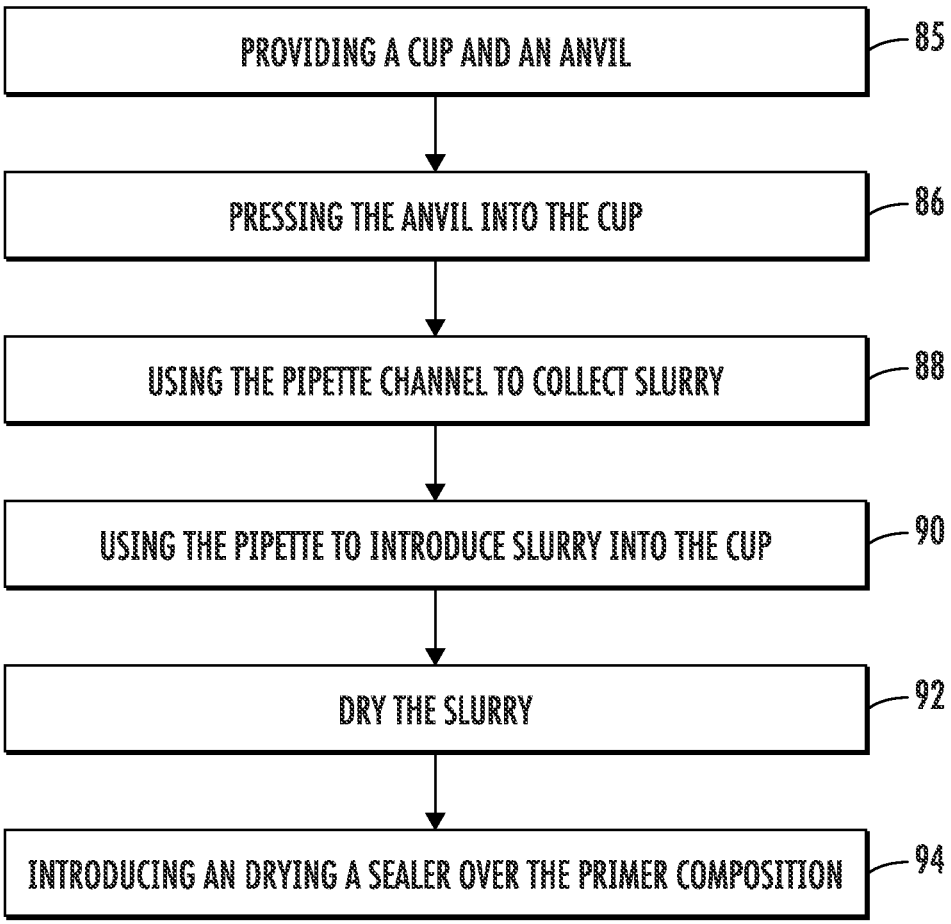
FIG. 18 is a flow chart of the primer assembly method of the present invention.

Primer 20 of the present invention is produced using a specific method which is made possible by the unique characteristics of anvil 24 as described previously. Referring to FIG. 18, a flow chart illustrates a method of assembling primer 20. The assembly of primer 20 begins with step 85, providing primer cup 22 and anvil 24. Primer cup 22 can be a standard cup as described previously. Anvil 24 is a unique anvil design which allows a slurry to flow off of the top surface thereof, as described previously. At step 86, anvil 24 is pressed into primer cup 22 firmly seating anvil 24 in primer cup 22 and defining a primer gap 40. At step 88, a slurry dispenser such as a pipette channel 82 collects a controlled volume of slurry 70. At step 90 pipette channel 82 (or other slurry dispensing device) introduces the controlled volume of slurry 70 into primer cup 22 to fill level 72. At a step 92, the carrier liquid is removed from slurry 70 by drying, to leave a deposit of primer composition 23 between cup base 25 of cup 22 and anvil base 38 of anvil 24. An optional step 94 includes introducing and drying a sealer over primer composition 23. The sealer is generally used when the primer is not used in a cartridge right away and needs to be stored for a period of time.

Thus described is a unique anvil allowing for a new primer assembly method. The shape of the anvil and use of a slurry of primer composition allows the primer composition to be introduced to the primer after the anvil and the cup have been joined together. The use of a slurry, enabled by the anvil, also enables the process to be automated using pipette channels for a safe and accurate introduction of primer composition to a primer.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

The invention claimed is:

1. A method of assembling a primer for a firearm cartridge comprising the steps of:

providing a primer cup including a cup base with a circular sidewall extending perpendicularly upward from a perimeter edge thereof, to a rim;

providing an anvil having an anvil base, the anvil base having open side edges and a top surface, the top surface facing away from the cup base and being flat or convex in a transverse direction between the side edges to cause flowing of a slurry off of the top surface and prevent collection of the slurry thereon;

pressing the anvil into the primer cup with the anvil base spaced apart from the cup base to form a primer gap therebetween;

providing the slurry including a primer composition and a carrier liquid;

introducing a controlled volume of the slurry into the primer cup over the anvil; and drying the slurry in the primer cup to remove the liquid carrier and leave a deposit of the primer composition in the primer gap.

2. A method as claimed in claim 1 wherein the step of providing an anvil includes the step of providing at least two upright legs, each extending upwardly from a separate end of the anvil base, the upright legs overlying and abutting the circular sidewall and extending from proximate the rim to the anvil base.

3. The method as claimed in claim 2 wherein the step of providing an anvil includes the step of providing the at least two upright legs each having a curve, the curve of the at least two upright legs matching a curve of the circular sidewall.

4. The method as claimed in claim 1 wherein the step of providing an anvil having an anvil base includes the step of providing the anvil base having a Y-shape and including three ends with three legs extending therefrom.

5. The method as claimed in claim 1 wherein the step of introducing a controlled volume of the slurry into the primer cup over the anvil includes the step of providing a slurry having at least 10% and no more than 60% primer composition solids.

6. The method as claimed in claim 1 wherein the step of introducing a controlled volume of the slurry includes the step of using at least one pipette channel to introduce the slurry.

7. The method as claimed in claim 1 further including the step of introducing and drying a sealer over the primer composition.

8. A method of assembling a primer for a firearm cartridge comprising the steps of:

providing a primer cup including a cup base with a circular sidewall extending perpendicularly upward from a perimeter edge thereof, to a rim;

providing an anvil having an anvil base and at least two upright legs, each of the at least two upright legs extending upwardly from a separate end of the anvil base, the anvil base having open side edges and a top surface, the top surface being flat or convex in a transverse direction between the side edges;

pressing the anvil into the primer cup with the top surface facing away from the cup base, the at least two upright legs overlying and abutting the circular sidewall and extending from proximate the rim to the anvil base, and the anvil base spaced apart from the cup base to form a primer gap therebetween;

providing a slurry including a primer composition and a carrier liquid;

introducing a controlled volume of the slurry into the primer cup over the anvil; and drying the slurry in the primer cup to remove the liquid carrier and leave a deposit of the primer composition in the primer gap.

9. The method as claimed in claim 8 wherein the step of introducing the slurry includes the step of filling the primer cup with the slurry from the cup base to a fill level above the anvil base.

10. The method as claimed in claim 9 wherein the step of drying the slurry includes the step of removing the liquid carrier from the slurry and lowering the slurry level from the fill level to a level below the anvil base, and includes the slurry flowing off of the top surface of the anvil base, prevent collection of the slurry thereon.

11. The method as claimed in claim 8 wherein the step of providing an anvil includes the step of providing the at least two upright legs each having a curve, the curve of the at least two upright legs matching a curve of the circular sidewall.

12. The method as claimed in claim 8 wherein the step of providing an anvil having an anvil base includes the step of providing the anvil base having a Y-shape and including three ends with three legs extending therefrom.

13. The method as claimed in claim 8 wherein the step of introducing a controlled volume of the slurry into the primer cup over the anvil includes the step of providing a slurry having at least 10% and no more than 60% primer composition solids.

14. The method as claimed in claim 8 wherein the step of introducing a controlled volume of the slurry includes the step of using at least one pipette channel to introduce the slurry.

15. The method as claimed in claim 8 further including the step of introducing and drying a sealer over the primer composition.

16. A primer for a firearm cartridge, the primer comprising:

a primer cup including a cup base with a circular sidewall extending perpendicularly upward from a perimeter edge thereof, to a rim;

an anvil including at least two upright legs extending perpendicularly upwardly from ends of an anvil base, the anvil base having a top surface directed away from the cup base and side edges forming open sides, wherein the top surface of the anvil base is flat or convex in a transverse direction between the side edges to prevent any fluid collection areas on the surface;

the anvil received within the primer cup with the upright legs overlying and abutting the circular sidewall and extending from proximate the rim to the anvil base and a primer gap defined between the cup base and the anvil base; and a primer composition deposited on the cup base in the gap from a slurry.

17. The primer for a firearm cartridge as claimed in claim 16 wherein the upright legs have a curve, the curve of the upright legs matching a curve of the circular sidewall.

18. The primer for a firearm cartridge as claimed in claim 16 wherein the base is Y-shaped and includes three ends with three legs extending therefrom.

* * * * *